United States Patent [19]

Eary

[11] Patent Number: 4,901,384

[45] Date of Patent: Feb. 20, 1990

[54] BODY PILLOW

[76] Inventor: Paul A. Eary, Rt. 15, Box 472, Oakland, Md. 21550-9805

[21] Appl. No.: 284,350

[22] Filed: Dec. 14, 1988

Related U.S. Application Data

[63] Continuation-in-part of Ser. No. 89,977, Oct. 19, 1987, abandoned.

[51] Int. Cl.[4] ..... A47C 20/00

[52] U.S. Cl. ..... 5/431; 5/436

[58] Field of Search ..... 5/431, 465, 464, 436, 5/437, 434, 441, 442

[56] References Cited

U.S. PATENT DOCUMENTS

| | | | |
|---|---|---|---|
| 1,045,228 | 11/1912 | Weltner | 5/436 |
| 2,933,738 | 4/1960 | Whelan | 5/436 |
| 3,626,526 | 12/1971 | Viel | 5/465 |
| 3,938,205 | 2/1976 | Spann | 5/431 |
| 4,173,048 | 11/1979 | Varaney | 5/436 |
| 4,441,221 | 4/1984 | Enste et al. | 5/431 |
| 4,624,021 | 11/1986 | Hofstetter | 5/431 |
| 4,635,306 | 1/1987 | Willey | 5/431 |
| 4,794,657 | 1/1989 | Avery | 5/465 |

*Primary Examiner*—Alexander Grosz

*Attorney, Agent, or Firm*—Fleit, Jacobson, Cohn, Price, Holman & Stern

[57] ABSTRACT

A body pillow (10) formed as a one-piece body-length soft foam cushion, somewhat irregular in overall shape, designed for resting or sleeping in a prone position, on either the right or left side. Portions of the pillow are interconnected by a full-length, comparatively narrow strip of foam (11) joined to a head section (12) supporting a user's head separately from one arm of the user. An intermediate section (14) of foam at the waist of the pillow supports a user's rib cage in such a way as to avoid an unnatural curvature of the user's spine. The foot of the pillow provides a sizable cushion disposed between the knees and ankles of the user. Design of the pillow provides a resting position allowing bodily appendages underneath the pillow to be free of the weight of those appendages resting above the pillow. The entire pillow may be covered with a one-piece fitted cover of cotton percale or similar material, with a full length closure extending along one side.

20 Claims, 3 Drawing Sheets

BODY PILLOW

CROSS-REFERENCE TO RELATED APPLICATION

This application is a continuation of application Ser. No. 07/089,977, filed 10/19/87, now abandoned.

TECHNICAL FIELD

This invention relates to pillows, and more particularly to large cushions for supporting a user reclining on either the user's right or left side.

BACKGROUND DISCUSSION

There has been a long-felt need in the art to provide pillows, cushions and mattresses facilitating the positioning, rest or sleep of a user while the body of the user is comfortably disposed in a articular position. References such as Weltmer, U.S. Pat. No. 1,045,228 and Wheylan, U.S. Pat. No. 2,933,738 disclose simple pads for use in conjunction with mattresses while Vail, U.S. Pat. No. 3,626,526 discloses a compound, multilayered mattress formed with a plurality of cut-outs from a base layer joined to one horizontal surface of the base layer. Other cushions and pillows such as those found in Varaney, U.S. Pat. No. 4,173,048, Spann, U.S. Pat. No. 3,938,205 and Hofstetter, U.S. Pat. No. 4,624,021 disclose discreet, unitary pillows designed to be placed adjacent to, and to partially underlie or be engaged by a reclining user, while supports and other cushions such as those found in Enste, U.S. Pat. No. 4,441,221 and Willey, U.S. Pat. No. 4,635,306 are dedicated principally to engaging the front, or reverse of a user's torso, typically while the user remains in a sitting, or partially reclining position.

While these and other examples of the pillow, cushion and support arts enable a user to remain in one or more positions with varying degrees of comfort, research among currently marketed body cushions fails to reveal the availability of any cushion or pillow designed to enable a reclining user to rest upon the pillow while on the user's right or left side with the bodily appendages disposed beneath the pillow to be free from direct application of the weight of the user's bodily appendages supported by the pillow.

STATEMENT OF THE INVENTION

It is, therefore, an object of the present invention to provide an improved body pillow.

It is another object to provide a body pillow enabling a reclining user to rest upon the pillow while the user is disposed on either the user's right or left side.

It is still another object to provide a body pillow which comfortably supports the major components of the user's body while bodily appendages of the user disposed beneath the pillow are freed from direct application of the weight of bodily appendages supported by the pillow.

It is yet another object to provide a body pillow which facilitates the resting of a user in a fetal position while supported by the pillow.

It is still yet another object to provide a body pillow which supports a larger portion of the anatomy of a reclining user.

It is a further object to provide a body pillow enabling a reclining user to comfortably rest while disposed in a position other than a face-up or face-down position.

It is a still further object to provide a body pillow for complementing the support and comfort provided to a reclining user by an underlying, conventional mattress.

It is a yet further object to provide a body pillow for supplementing an underlying conventional mattress while minimizing contact between the horizontal supporting surfaces of the underlying mattress and bed sores of a reclining user It is also an object of the present invention to provide a pillow facilitating the comfort of a user during a short-term nap.

These and other objects are achieved with a body pillow provided by a single unit of a soft foam material enabling a user to rest, or to sleep, on either the right or left side of the user. The body pillow includes four separate, major sections each separately providing cushioning support for the head, one arm, rib cage and/or waist, and the knee and ankle of one leg of a reclining user. The shoulder, other arm and leg of the user may be supported by an underlying conventional mattress or other substantially flat substrate surface disposed beneath the body pillow. The four major sections of the body pillow are interconnected by a narrow, soft foam section approximating the body length of the user, to maintain proper positional relations between the four major sections. Corners of the pillow may be squared to provide support for a wider variety of reclining positions by a user.

BRIEF DESCRIPTION OF THE DRAWINGS

A more complete appreciation of this invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
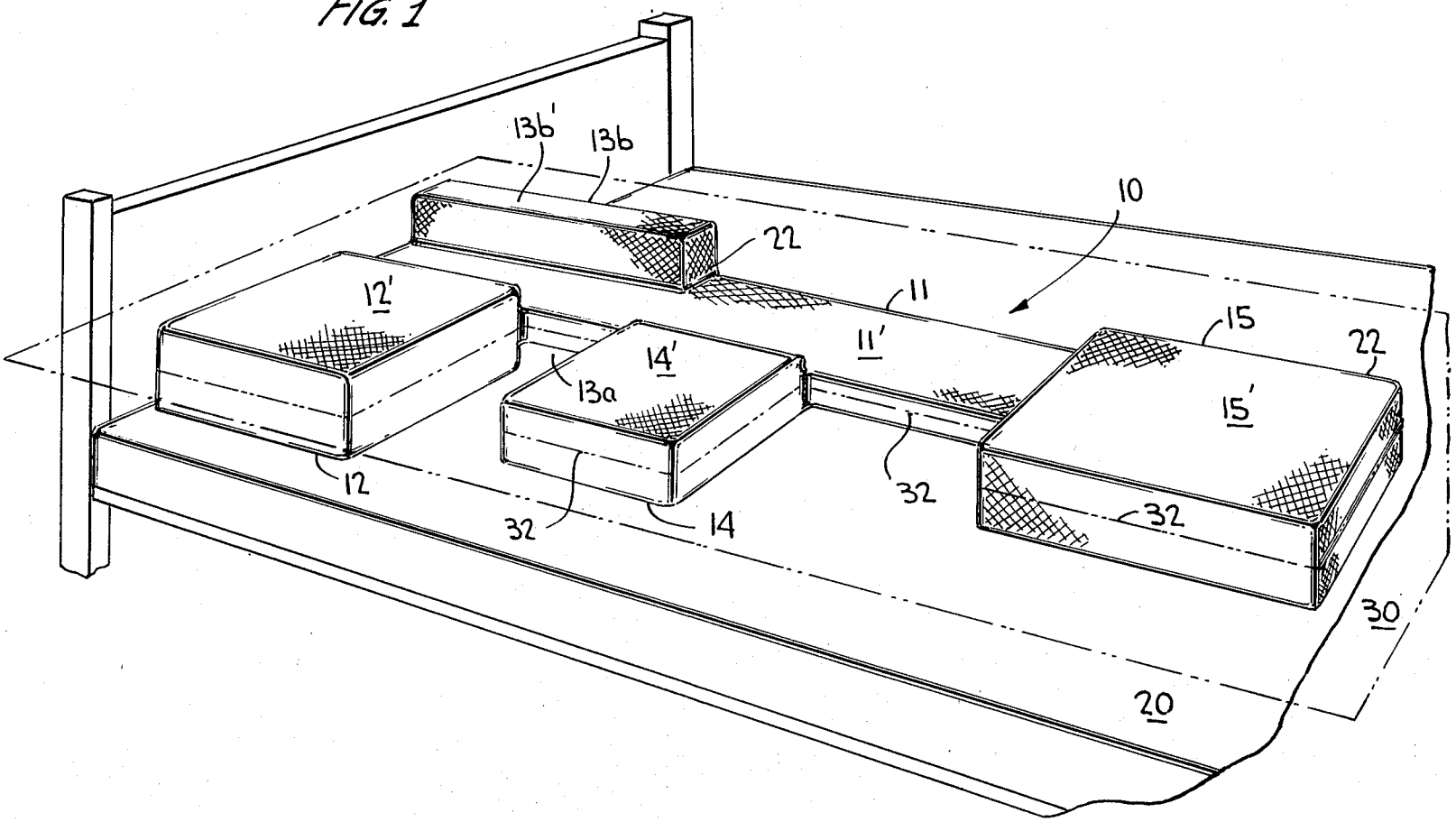
FIG. 1 is an orthagonal projection of one embodiment constructed according to the principles of the disclosed invention.
Figure 2:
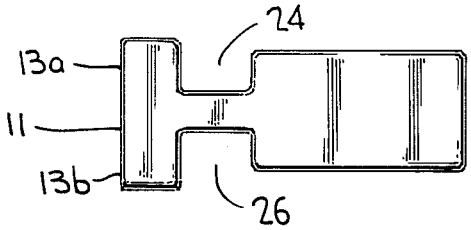
FIG. 2 provides an end view of one side of the embodiment of FIG. 1.

Referring now to the Figures, and in particular to FIGS. 1 through 5 and 7, a pillow (10) is formed with an elongate, flexible volume of a resilient mass of material such as, for example, foam rubber, forming a connecting section (11) providing opposite horizontal planar surfaces (11') capable of supporting human anatomical members of a reclining user. A plurality of major sections including a head section (12), an intermediate section (14) and a leg section (15) are spaced-apart and joined to vertical sides of connecting section (11) which are intermediate to support surfaces (11'). Each of the major sections (12), (14), and (15) provide two opposite support surfaces (12'), (14'), and (15') respectively, for supporting human anatomical members of a reclining user. An upper arm section (13*a*) and a lower arm section (13*b*) (shown inverted in FIG. 1 and with nominal orientation in the end view of FIG. 2), are joined to support surfaces (11') with an adjacent, but spaced-apart neighboring relation to head section (12). Upper and lower arm sections (13*a*), (13*b*) are disposed on opposite support surfaces (11') of connecting section (11), and provide support surfaces (13*a*'), (13*b*'), whereby one arm of a reclining user may rest upon the uppermost support surface (13*a*'), (13*b*'), depending upon the orientation of pillow (10).

As shown in FIG. 1, head, intermediate and leg sections (12), (14) and (15). as well as upper and lower arm sections (13*a*), (13*b*) are joined to connecting section (11) to form an integrated, single structure for pillow (10). Pillow (10) may be covered with a one-piece sewn cover (22) of cotton percale or similar material. In situations where price considerations are secondary, two covers, one a patterned material serving as an outer cover, can be used to encase pillow (10). A full length closure in cover (22) may be provided along the relatively straight side of the cover as the cover would appear if shown in the side view presented by FIG. 3.

Figure 4:
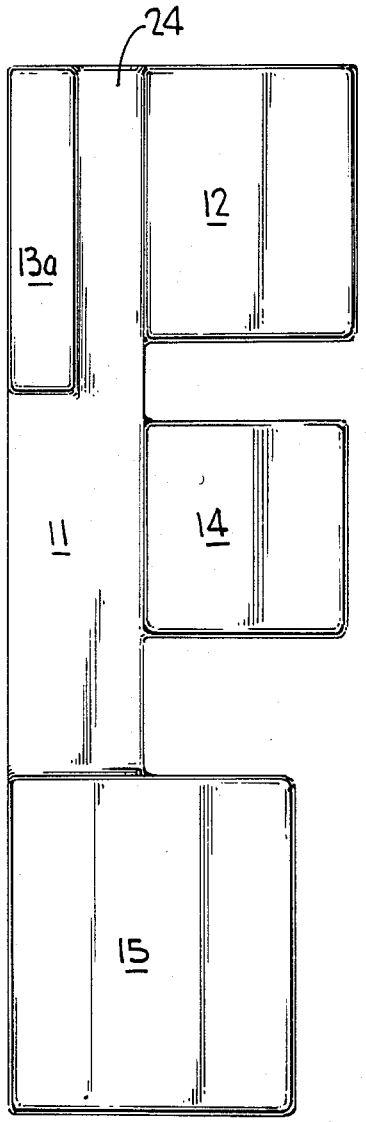
FIG. 4 provides a plan view of the embodiment of FIG. 1, showing the areas of that embodiment disposed on or adjacent to the horizontal surface of a supporting substrate.
Figure 5:
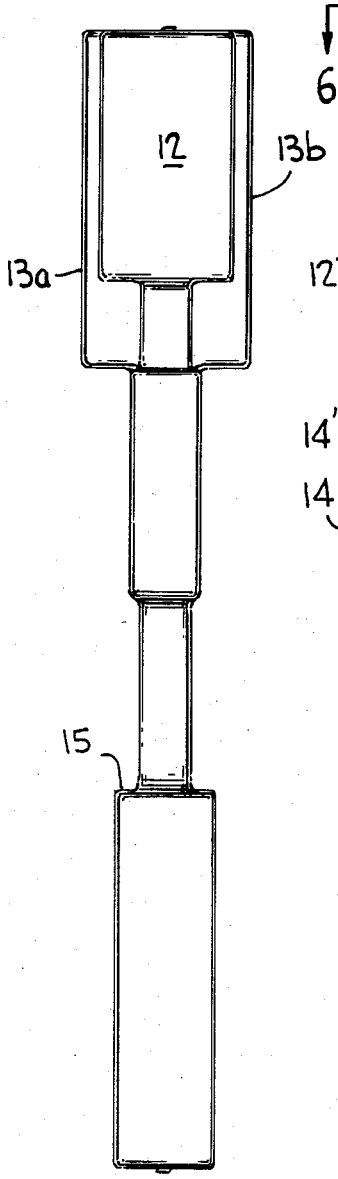
FIG. 5 provides a frontal view of another side of the embodiment of FIG. 1.
Figure 8:
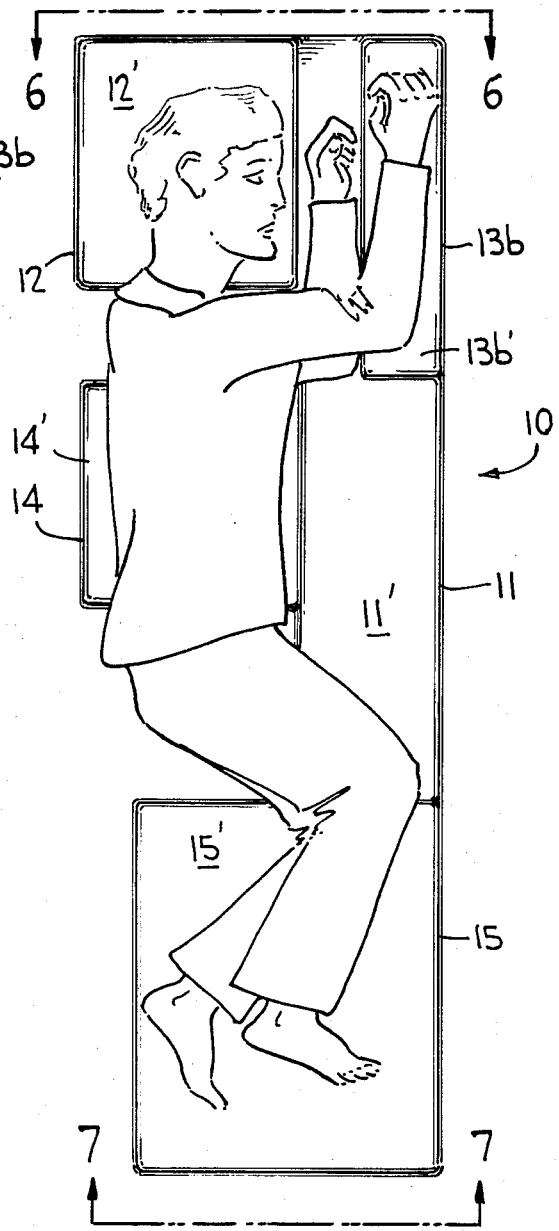
FIG. 8 provides a plan view showing the disposition of a human user upon the embodiment of FIG. 1.
Figure 3:
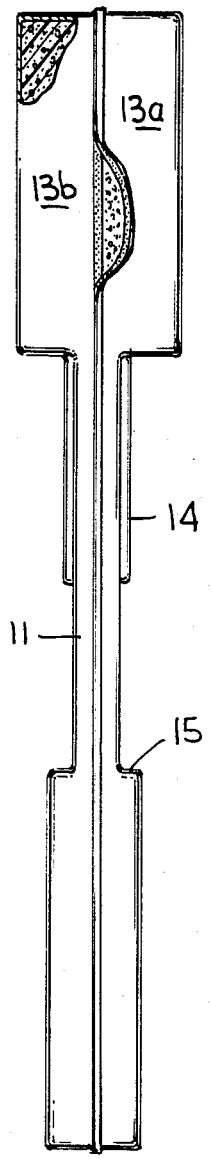
FIG. 3 provides a front view taken along one side of the embodiment of FIG. 1.
Figure 7:
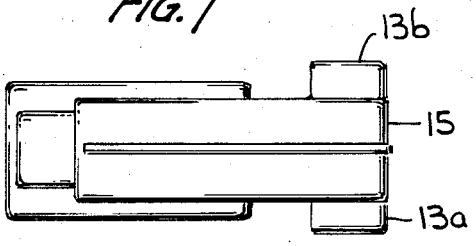
FIG. 7 provides a side view of an end opposite from the view shown in FIG. 6, of the embodiment shown in FIGS. 1 and 8.
Figure 6:
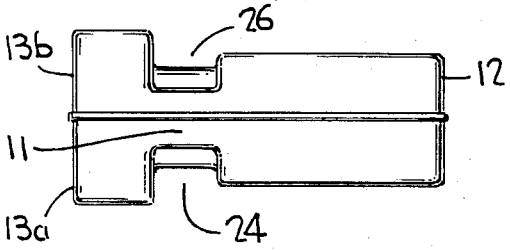
FIG. 6 provides a side view of one end of the embodiment of FIG. 1, when placed in the disposition shown in FIGS. 1 and 8.

As indicated by FIGS. 4, 7 and 8, one vertical side of connecting section (11) forms a generally flush vertical surface with adjacent vertical surfaces of upper and lower arm sections (13*a*), (13*b*) and leg section (15). When in a reclining position, with pillow (10) supported on a generally horizontal, planar surface such as that provided by a conventional bedroom mattress or, alternatively, a floor (preferably with a carpeted surface), the head of a user may be supported by horizontal surface (12') while the torso and lower leg (and ankle) may be supported by horizontal surfaces (14'), (15'), respectively. As indicated in FIG. 6 and shown by FIG. 8, when a user is reclining upon the user's left side, the right arm of the user may rest upon and be supported surface (13*b*') while the left arm of the user may be placed in a valley (24) beneath connecting section (11) and between head section (12) and arm section (13*a*). This advantageously enables the left arm of the reclining user to comfortably rest without bearing the weight of either the head, right arm or other anatomical members of the user. Additionally, when reclining upon the user's left side as shown in FIG. 8, the left leg of the user may be placed between the supporting substrate (such as the upper surface of mattress (20) and the adjacent underside surface (15') while the right leg rests upon and is supported by the exposed upper surface (15') of leg section (15)), as shown in FIG. 8. Alternatively, both the left and right legs may rest upon and be supported by the exposed uppermost surface (15') of leg section (15) while the lower, undersurface (15') rest fully and directly upon the uppermost surface of mattress (20). As indicated in FIGS. 1, 2, 3, and 5 through 7, head, intermediate and leg sections (15) are symmetrically arranged about a horizontal plane (30) which, as shown in FIG. 1, is generally parallel to the uppermost surface of a mattress (20) and which bisects connecting section (11) when sections (11), (12), (14) and (15) of pillow (10) rest upon the uppermost surface of mattress (20). Plane (30) will, due to the horizontally symmetric arrangement of sections (12), (14) and (15) relative to connecting section (11) also bisect sections (12), (14) arms sections (13*a*) (13*b*) as indicated by the lines of intersection (32) between these sections and plane (30) shown in FIG. 1.

It may be appreciated, therefore, that pillow (10) is reversible, thereby enabling a user to recline upon either the user's right or left side with a right arm of the user disposed beneath section (11) within valley (24) or, while the user reclines upon the user's right side, with the user's left arm disposed within valley (26) beneath connecting section (11).

EXAMPLE

One embodiment of a pillow was constructed with the dimensions indicated in Table I:

TABLE I

Head Section (12) 12-inch by 6-inches thick supporting a user's head;

Upper and lower arm sections (13*a*), (13*b*) with intermediate connecting section (11);

3-inch by 1/7-inch by 8-inches supporting the user's upper arm;

Intermediate section (14): 12-inch by 12-inch by 3-inches thick supporting the user's rib cage and waist;

Leg section (15): 15-inch by 32-inch by 4-inches thick supporting the user's upper knee, ankle and foot.

Vertical thicknesses of the supporting sections may be made of foam and may be varied according to personal needs, but for an average adult would be as indicated in Table I, when measured from the uppermost supporting surfaces of mattress (30) or other flat surface. For an average adult, the widest portion of pillow (10) would be approximately nineteen and one-half inches, as measured in the plane of FIGS. 2 and 6. Length, as measured in the planes of FIGS. 3 through 5 and 8, would be approximately sixty-five inches. These overall dimensions, may vary according to the age and size of the user.

Mattress (10) may be constructed by cutting the several sections from larger sheets of foam material, and then fitting and gluing those sections together. Alternatively, mattress (10) may be constructed from a soft foam material in an injection mold process, thereby simplifying its manufacture and minimizing cost. Other embodiments may be constructed as ballons, or inflated pillows, to further minimize cost of manufacture.

In view of the foregoing, it may be seen that the foregoing paragraphs describe a pillow suitable for use by both able and well individuals where a primary concern is comfort, and cost is a secondary consideration, and for disabled or convalescent patients in hospital and nursing care facilities to enable a reclining user to comfortably rest on either the user's left or right side, for either extended or short-term periods. While the configuration of pillow (10) encourages resting in a fetal position, the irregular shape of the pillow does not necessarily dictate either the length of time which the pillow may be used during a period of rest or a limitation of body positions while resting.

It is evident that those skilled in the art may now make numerous uses and modifications or departures from the specific embodiments described herein without departing from the inventive concepts disclosed.

The shape and design of the pillow and its several sections serve principally to illustrate the principles of the invention and may be modified without departing from those principles. Consequently, the invention is to be construed as embracing each and every novel feature and combination of features present in or possessed by the pillow herein disclosed, and is to be limited solely by the spirit and scope of the appended claims.

I claim:

1. A pillow, comprising:

connecting means formed by an elongate flexible volume exhibiting deformable resilient support surfaces on opposite sides of a horizontal plane bisecting said connecting means, for supporting human anatomical members; and a multiplicity of spaced-apart major sections of flexible volumes each jointed to and extending distally outward on both sides of said horizontal plane from said connecting means, with each of said major sections being formed by flexible volumes and exhibiting deformable, resilient support surfaces on opposite sides of said horizontal plane for supporting human anatomical members, with each of said major sections being disposable upon a horizontal substrate underlying said connecting means and said major sections, with a plurality of said major sections jointed to different sides of said connecting means, and with a first pair of said major sections having vertical thicknesses greater than a vertical thickness of said connecting means adjacent to said pair of major sections when said connecting means and said major sections are disposed upon and supported by a horizontal substrate.

2. The pillow of claim 1, further comprised of said support surfaces of said connecting means on both sides of said horizontal plane having substantially equal surface areas, and said support surfaces of each of said major section having substantially equal surface areas on both sides of said horizontal plane.

3. The pillow of claim 2, further comprised of said major sections being symmetrically disposed about said horizontal plane.

4. The pillow of claim 2, further comprised of a second pair of said major sections being disposed on opposite ones of said support surfaces of said connecting means, in a spaced-apart disposition relative to neighboring ones of other said major sections.

5. The pillow of claim 1, further comprised of said major sections being symmetrically disposed about said horizontal plane.

6. The pillow of claim 5, further comprised of a second pair of said major sections being disposed on opposite ones of said support surfaces of said connecting means, in a spaced-apart disposition relative to neighboring ones of other said major sections.

7. The pillow of claim 1, further comprised of means for joining said connecting means and said plurality of other sections together as a unitary structure.

8. The pillow of claim 7, further comprised of said joining means forming a one-piece cover of the pillow.

9. The pillow of claim 1, further comprised of a second pair of said major sections being disposed on opposite ones of said support surfaces of said connecting means, in a spaced-apart disposition relative to neighboring ones of other said major sections.

10. A pillow, comprising:

an elongate, flexible connecting section having a pair of oppositely disposed, deformable resilient support surfaces for supporting human anatomical members;

a head section adjoining and extending distally outward from a first vertical side of said connecting member, and providing oppositely disposed, deformable resilient support surfaces for supporting human anatomical members;

upper and lower arm sections joined to and extending distally outward from said support surfaces of said connecting section, each of said upper and lower arm sections being spaced apart from said head supporting human anatomical member;

an intermediate section joined to and extending distally outward from said first vertical side and providing oppositely disposed deformable resilient support surfaces for supporting human anatomical members, said intermediate section being spaced-apart from said head, upper and lower arm section; and a leg section joined to and extending distally outward from a second vertical side of said connecting section and providing oppositely disposed deformable, resilient support surfaces for supporting human anatomical members, said leg section being spaced-apart from said head, upper and lower arm and intermediate sections;

said head section having vertical thickness greater than a vertical thickness of said connecting section at a region of said connecting section adjacent to said head section when said support surfaces of said head and connecting sections are disposed upon and supported by a horizontal substrate.

11. The pillow of claim 10, further comprised of said upper and lower arm sections in combination with a volume of said connecting section intermediate to said upper and lower arm sections exhibiting a vertical thickness not less than said vertical thickness of said head section when said support surfaces of said connecting and head sections are disposed upon and supported by a horizontal substrate.

12. The pillow of claim 11, wherein said head, upper and lower arm, intermediate and leg sections are symmetrically disposed about a horizontal plane bisecting said connecting section.

13. The pillow of claim 11, wherein said support surfaces of said connecting section have substantially equal surface areas, and said opposed surfaces of each of said head, upper arm and lower arm, intermediate and leg sections have substantially equal surface areas.

14. The pillow of claim 10, wherein said head, upper and lower arm, intermediate and leg sections are symmetrically disposed about a horizontally plane bisecting said connecting section.

15. The pillow of claim 10, wherein said support surfaces of said connecting section have substantially equal surface areas, and said opposed surfaces of each of said head, upper arm and lower arm, intermediate and leg sections have substantially equal surface areas.

16. A pillow, comprising:

connecting means formed by an elongate, flexible volume exhibiting deformable resilient support surfaces on opposite sides of a horizontal plane bisecting said connecting means, for supporting human anatomical members;

a multiplicity of spaced-apart major sections each joined to and extending distally outward on both sides of said horizontal plane from said connecting means, with each of said major sections being formed by flexible volumes and exhibiting deformable, resilient support surfaces on opposite sides of said horizontal plane for supporting human anatomical members, with each of said major sections being disposable upon a horizontal substrate underlying said connecting means and said major sections, with a plurality of said major sections joined to different sides of said connecting means, and with a first pair of said major sections having a vertical thicknesses greater than a vertical thickness of said connecting means adjacent to said pair of major sections when said connecting means and said major sections are disposed upon and supported by a horizontal substrate; and one of said first pair of major sections formed by a first one of said flexible volumes adjoining a major one of said different sides, and a third one of said major sections formed by a second one of said flexible volumes adjoining a first one of said support surfaces of said connecting means, with said first and second ones of said flexible volumes being spaced apart by a portion of said first one of said support surfaces of said connecting means and first second support surfaces provided by said first and second ones of said flexible volumes defining one or more places disposed apart from said first one of said support surfaces of said connecting means to form a first void disposed between said first and second ones of said flexible volumes.

17. The pillow of claim 16, further comprised of means for joining said connecting means and said plurality of other sections together as a unitary article.

18. The pillow of claim 16, further comprised of a fourth one of said major section formed by a third one of said flexible volumes adjoining a second one of said support surface of said connecting means and providing a third support surface displaced apart from said second one of said support surface of said connecting means to form a second void disposed between said first and third ones of said flexible volumes.

19. The pillow of claim 18, further comprised of said second and third ones of said flexible volumes being separated by said connecting means.

20. The pillow of claim 18, further comprised of means for joining said connecting means and said plurality of other sections together as a unitary article.

* * * * *